United States Patent [19]

Mains, Jr.

[11] Patent Number: 4,509,544

[45] Date of Patent: Apr. 9, 1985

[54] TUBE BUNDLE CLEANING APPARATUS

[76] Inventor: Gilbert L. Mains, Jr., 2767 Warwick Dr., Bloomfield Hills, Mich. 48013

[21] Appl. No.: 527,092

[22] Filed: Aug. 29, 1983

[51] Int. Cl.[3] ..... B08B 3/02; B08B 9/02

[52] U.S. Cl. ..... 134/144; 134/148; 134/152; 134/167 C; 134/168 C; 239/555

[58] Field of Search ..... 134/99, 137, 140, 141, 134/144, 145, 147, 148, 151, 152, 153, 157, 165, 166 C, 167 C, 168 C, 169 C, 170, 171, 180, 181, 199; 239/548, 555, DIG. 1; 165/95

[56] References Cited

U.S. PATENT DOCUMENTS

| | | | |
|---|---|---|---|
| 2,342,757 | 2/1944 | Roser | 239/536 |
| 3,052,245 | 9/1962 | Nagle | 134/144 |
| 3,060,064 | 10/1962 | Zingg | 134/144 X |
| 3,214,867 | 11/1965 | Henning | 134/152 X |
| 3,225,777 | 12/1965 | Shelton et al. | 134/152 X |
| 3,595,250 | 7/1971 | Hurst | 134/181 X |
| 3,703,905 | 11/1972 | Ice, Jr. | 134/152 X |
| 3,786,823 | 1/1974 | Wiley | 134/181 X |
| 4,095,305 | 6/1978 | Goodwin | 134/167 C |

*Primary Examiner*—Stephen Marcus

*Attorney, Agent, or Firm*—Reising, Ethington, Barnard, Perry & Milton

[57] ABSTRACT

Tube bundle cleaning apparatus is disclosed in which cleaning is effected by high pressure water jets impinging upon the tubes of the bundle. The tube bundle is supported on power rollers and a pair of carriages are disposed on opposite sides of the bundle. Each carriage supports a rotatable cleaning head and a non-rotatable cleaning head, both of which are adjustably positionable on the carriage for obtaining optimum location relative to different size tube bundles. The non-rotatable cleanig head includes plural sets of jet nozzles, each set being adjustable in the vertical direction to provide optimum spacing relative to different size tubes to be cleaned. The carriages are mounted on respective tracks for reversibly traversing the tube bundle in repeated cycles to clean a selected swath of the bundle. When the selected swath is cleaned, the tube bundle is rotated to another angular position by the power rollers for cleaning of another swath. The process is repeated until the entire tube bundle is cleaned.

7 Claims, 8 Drawing Figures

TUBE BUNDLE CLEANING APPARATUS

FIELD OF THE INVENTION

This invention relates to cleaning apparatus for tube bundles; more particularly, it relates to high pressure liquid jet apparatus for cleaning the exterior walls of the tubes of a tube bundle.

BACKGROUND OF THE INVENTION

In the petroleum refining industry, heat exchangers of the shell and tube type are commonly used to transfer heat from one fluid to another. Such heat exchangers comprise an outer cylindrical shell and a tube bundle positioned within the shell. The tube bundle comprises a multiplicity of individual tubes retained in position in the bundle by plural tube support plates. In this type of heat exchanger, one fluid is passed through the tubes from one end of the shell to the other and another fluid is passed through the shell around the tubes. In use, the tubes become coated with material due to deposits or corrosive action of the fluid passing over the tube. Such deposits impair the heat transfer capability and restrict the fluid flow around the tube bundle. Accordingly, it becomes necessary periodically to clean the deposits from the exterior walls of the tubes to restore the efficiency of the heat exchanger. Tube bundles in refinery applications are large and heavy; typically, bundles may be in the range of 10 to 30 feet in length and 1 to 3 feet in diameter. Accordingly, it is highly desirable to clean the bundles at the installation site to minimize the handling and transport of the bundles.

In the prior art, apparatus is known for cleaning heat exchanger tube bundles at the installation site. Typical of such prior art is that disclosed in the Nagle U.S. Pat. No. 3,052,245. The apparatus of this patent comprises a power operated roller for supporting the tube bundle for rotational positioning and a beam extending parallel to the rollers for supporting a carriage for a cleaning head. The cleaning head comprises two pairs of nozzles which discharge high velocity, high pressure jets of water against the tubes of the tube bundle. The cleaning head is mounted on slides which are inclined relative to the horizontal and the heads may be adjustably positioned so that the nozzles are properly spaced from the tube bundles in accordance with the bundle size. The carriage is adapted to traverse the beam from one end to the other so that the jets from the nozzles impinge on the tubes throughout the length of the tube bundle in repeated cycles. A similar cleaning apparatus for tube bundles is shown in the Zingg U.S. Pat. No. 3,060,064 and the Shelton et al U.S. Pat. No. 3,225,777. In the Ice U.S. Pat. No. 3,703,905, cleaning apparatus for tube bundles is disclosed with the bundle supported on a pair of dollies with power rollers and a boom extending between the dollies. The boom carries the cleaning head which discharges high pressure water for cleaning the tube bundle. In use, the boom is moved arcuately of the tube bundle and the cleaning head is moved back and forth along the boom.

A general objective of this invention is to provide an improved tube bundle cleaning apparatus and overcome certain disadvantages of the prior art.

SUMMARY OF THE INVENTION

This invention provides an improved tube bundle apparatus which is capable of removing deposits from individual tubes in the bundle at a high speed. This is accomplished by nozzles for impacting the tube bundle with high velocity, high pressure liquid jets over a wide angle of coverage. The tube bundle is supported on a set of power driven rollers adapted to receive a tube bundle for cleaning and to rotate it about its longitudinal axis for positioning the bundle. A carriage is movably supported on a horizontal track extending parallel to the rollers and a non-rotatable cleaning head is mounted on said carriage. The cleaning head includes plural sets of nozzles, each set being directed transversely of the bundle and connected with a source of high pressure liquid. First and second head positioning means are provided for adjustably positioning the head on the carriage in the vertical and the horizontal directions, respectively. Nozzle positioning means is provided for adjustably positioning the sets of nozzles relative to each other on the head. Power actuated means are provided for reversibly driving said carriage along said track between the ends of the tube bundle.

Further, according to this invention, a rotary cleaning head is mounted on the carriage and includes a rotary member with a pair of diametrically opposite nozzles pointed in a horizontal plane and adapted to be connected with the source of high pressure fluid. The non-rotatable cleaning head and the rotatable cleaning head are positioned on the carriage in such a manner that the liquid jets from the respective heads provide wide coverage of the tube bundle at predetermined range and angularity of impact.

Further, according to this invention, first and second carriages are supported on first and second horizontal tracks, respectively, extending parallel to the rollers on opposite sides thereof. First and second non-rotatable cleaning heads are mounted on the first and second carriages, respectively, with each of the cleaning heads including plural sets of nozzles and each of the sets being pointed transversely of the tube bundle in the horizontal plane. Each head is adjustably positioned in both the vertical and horizontal directions and the sets of nozzles are adjustably positioned relative to each other on both heads. Further, first and second rotatable cleaning heads are mounted on the first and second carriages, respectively. Each rotatable head is adjustably positioned in the vertical direction. A third rotatable cleaning head may be mounted on a bridge between the carriages and positioned over the tube bundle.

Further, in accordance with this invention, a non-rotatable cleaning head is provided which comprises a plurality of nozzle holders, each being slidably mounted on a base member whereby the nozzle holders can be positioned relative to each other. Each of the nozzle holders preferably comprises a flat plate disposed in a vertical plane with successive ones of the plates being disposed face-to-face whereby the plates are slidably mounted for positioning in a vertical direction. A set of nozzles is mounted on each of the flat plates and are spaced from each other in the vertical direction.

A more complete understanding of this invention may be obtained from the detailed description that follows taken with the accompanying drawings.

BEST MODE FOR CARRYING OUT THE INVENTION

Figure 1:
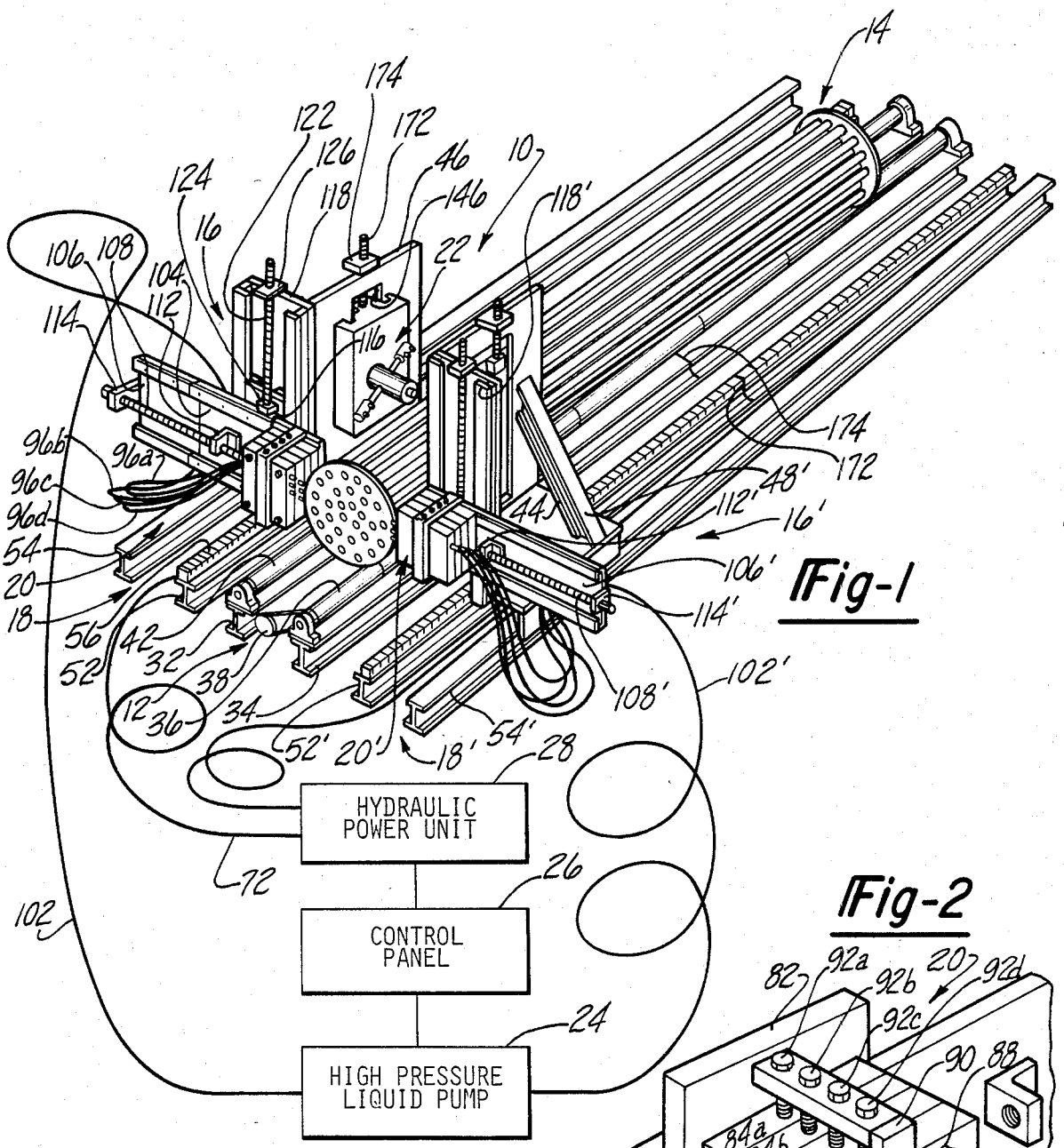
FIG. 1 is a perspective view of the cleaning apparatus of this invention.

Referring now to the drawings, there is shown an illustrative embodiment of the invention in a cleaning apparatus for tube bundles of the type used in heat exchangers. As the description proceeds, it will become apparent that the invention is useful in other embodiments and in other applications.

The cleaning apparatus of this invention is shown in perspective view in FIG. 1. In general, the cleaning apparatus 10 comprises a set of power rollers 12 for supporting a tube bundle 14 to be cleaned. A pair of carriages 16 and 16' are mounted on respective pairs of rails 18 and 18'. The carriage 16 carries a non-rotatable cleaning head 20 and a rotatable cleaning head 22. Similarly, the carriage 16' carries a non-rotatable cleaning head 20' and a rotatable cleaning head 22' (not shown in FIG. 1) which is identical to the cleaning head 22. The cleaning heads are of the high pressure, high velocity, liquid jet type and will be described in greater detail subsequently. The high pressure liquid pump 24 is adapted to supply cleaning liquid to the cleaning heads at high pressure in the vicinity of 10,000 PSI. The pump 24 is manually controlled through a control panel 26 by the operator of the cleaning apparatus. A hydraulic power unit 28 is also controlled by the operator through the control panel 26 for driving the carriages 16 and 16', as will be described subsequently.

The cleaning apparatus 10 will now be described in greater detail. The set of power rollers 12 comprises a pair of beams 32 and 34 which extend a sufficient length to accommodate the full length of different tube bundles. Typically, tube bundles may be of a length in the range of 10 to 20 feet with a diameter in the range of 2 to 3 feet. The beams 32 and 34 are suitably connected together to form a rigid frame which is set on level ground or on a floor, as the case may be. A drive roller 36 is mounted by pillow blocks on the beam 34 and is rotatably driven by a motor 38. An idler roller 42 is mounted by pillow blocks on the beam 32. The tube bundle 14 is supported by its end plates on the rollers 36 and 42. The bundle 14 may be rotated about its longitudinal axis to adjust its angular orientation by energizing the motor 38 to rotate the drive roller 36. The rollers 36 and 42 preferably comprise plural sections with bearing blocks therebetween to support the load of the tube bundle.

The carriage 16 which carries the non-rotatable cleaning head 20 and the rotatable cleaning head 22 is adapted to traverse the full length of the tube bundle 14 on the set of tracks 18. The carriage 16' is a mirror image of the carriage 16 and is comprised of identical parts; it is adapted to traverse the full length of the tube bundle 14 on the set of tracks 18'. Since the carriage 16' and the tracks 18' are mirror images of the carriage 16 and tracks 18 and comprise identical parts, the description that follows will be given with reference to carriage 16 and tracks 18 only.

Figure 7:
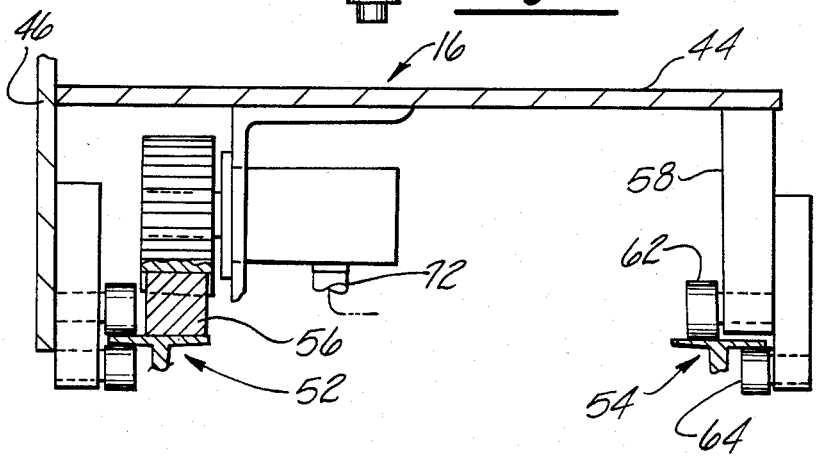
FIG. 7 shows the carriage drive arrangement of the cleaning apparatus.

The carriage 16 (see FIGS. 1, 7 and 8) comprises a base plate 44 which is supported for movement along the tracks 18 in a manner to be described subsequently. A vertical plate 46 is mounted on the base plate 44 and is supported thereon by a diagonal frame member 48. The carriage 16 is supported through the base plate 44 for movement on the set of tracks 18 in the following manner.

The set of tracks 18 comprises a drive track 52 and a guide track 54. The tracks 52 and 54 are interconnected with each other (and with the set of tracks 18') by frame members, not shown, to form a rigid structure. The drive track 52 comprises an I-beam with a rack gear 56 mounted on top and extending the full length of the beam. The guide track 54 comprises a simple I-beam. The base plate 44 is supported on the guide track 54 through a depending flange 58 and a pair of support wheels 62 and 64. The base plate 44 is supported on the drive track 52 through the vertical plate 46 on which is mounted a pair of support wheels 66 and 68.

The carriage 16 is power driven along the tracks 52 and 54 by a hydraulic drive motor 72. The drive motor is coupled through a drive pinion 74 to the rack gear to impart driving effort to the carriage 16. The hydraulic motor 16 is reversible to drive the carriage 16 in either direction and cause it to repeatedly traverse the full length of the tube bundle 14. The hydraulic motor 16 is energized with hydraulic fluid from the hydraulic power unit 28 through a flexible hose 76. The motor 72 may be manually controlled by the operator at the control panel 26. If desired, the motor is automatically controlled for repeated traversing of the carriage by suitable limit switches on the set of tracks 18 which may be adjusted to set the distance of traverse in accordance with the length of the tube bundle.

Figure 2:
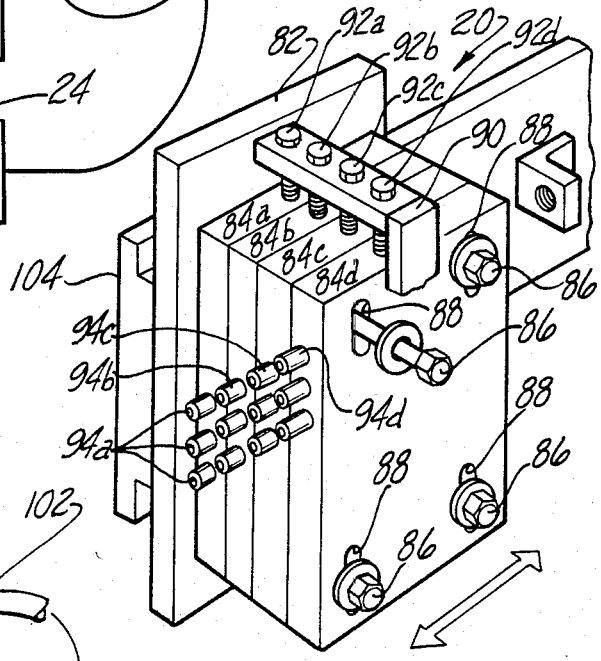
FIG. 2 is a perspective view of a non-rotary cleaning head.

The non-rotatable cleaning head 20 is best shown in FIGS. 1 and 2. It comprises a support plate 82 and a plurality of manifold nozzle plates 84*a*, 84*b*, 84*c* and 84*d*. The manifold nozzle plates are disposed successively in face-to-face relationship in the vertical plane and are mounted on the support plate 82 by clamping bolts 86 which extend through adjustment slots 88 in the nozzle plates. An adjustment bracket 90 is supported on the base plate 82 and spans the upper ends of the stack of nozzle plates. The bracket 90 carries a set of adjustment screws 92*a*, 92*b*, 92*c* and 92*d* which are threadedly engaged with the nozzle plates 84*a*, 84*b*, 84*c* and 84*d*, respectively. With the clamping bolts 86 loosened, the adjustment screws 92*a*, 92*b*, 92*c* and 92*d* may be individually turned to raise or lower the individual nozzle plates 84*a*, 84*b*, 84*c* and 84*d* to positionally adjust them relative to each other in the vertical plane for purposes to be described subsequently.

Figure 3:
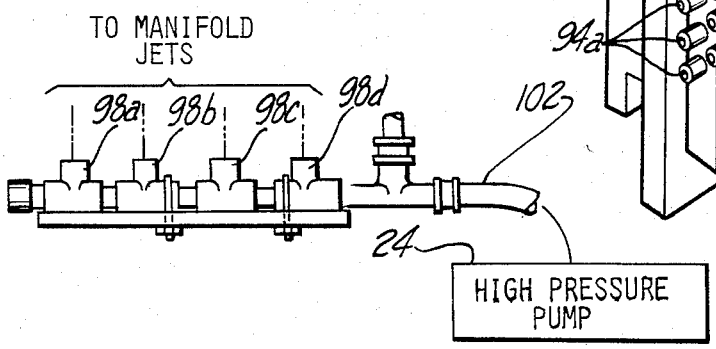
FIG. 3 shows a part of the plumbing system.
Figure 4:
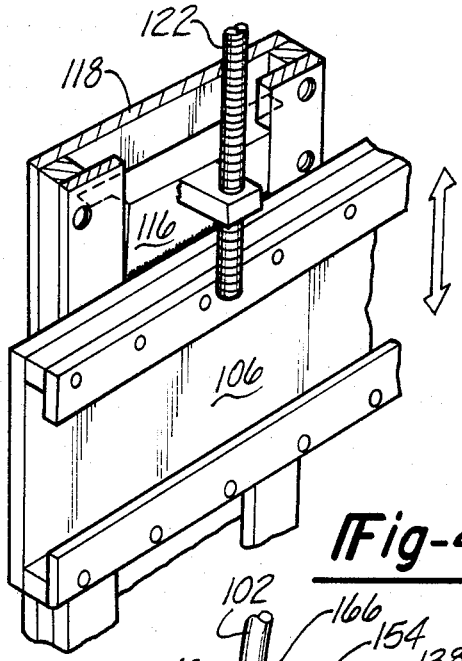
FIG. 4 shows the adjustable mount for the non-rotary cleaning head.
Figure 5:
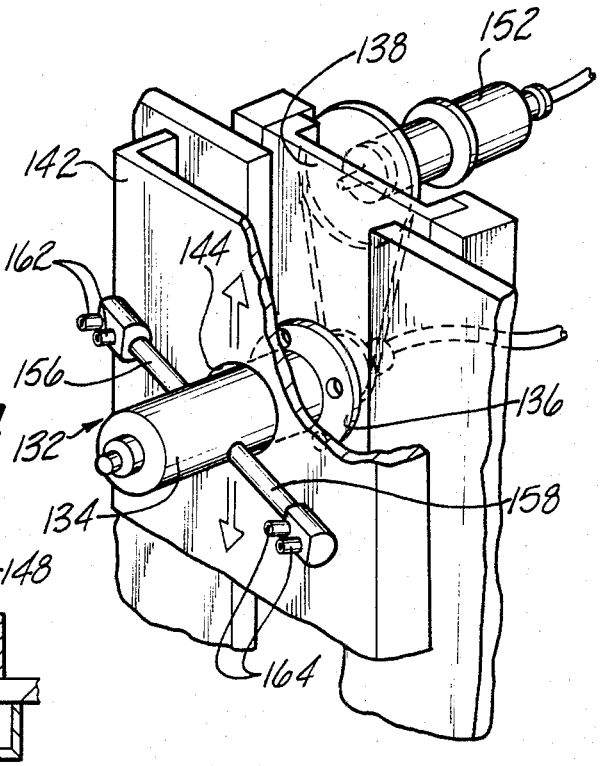
FIG. 5 is a perspective view of a rotary cleaning head.
Figure 6:
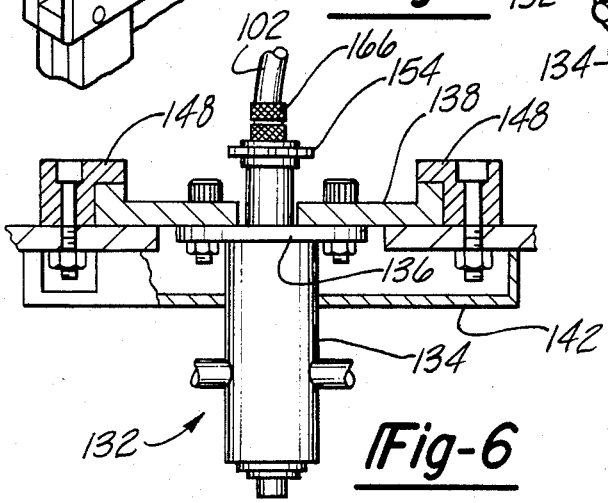
FIG. 6 shows further detail of the rotary cleaning head.

Each of the manifold nozzle plates 84*a*, 84*b*, 84*c* and 84*d* is provided with a set of liquid jet nozzles 94*a*, 94*b*, 94*c* and 94*d*, respectively, there being three nozzles in each set. Each nozzle is of the type adapted to produce a solid stream of liquid at high velocity. The manifold nozzle plates 84*a*, 84*b*, 84*c* and 84*d* are provided with respective inlet fittings which are connected with high pressure, flexible hoses 96*a*, 96*b*, 96*c* and 96*d*, respectively. The inlet fitting of each nozzle plates is in fluid communication with each of the respective nozzles through interior passages in the nozzle plate. The flexible hoses 96*a*, 96*b*, 96*c* and 96*d* are connected to respective fittings 98*a*, 98*b*, 98*c* and 98*d* (see FIG. 3) in a high pressure supply hose 102 connected with the pump 24.

The non-rotatable cleaning head 20 is mounted for adjustable positioning relative to the tube bundle 14 in the following manner. The support plate 82 is mounted on a horizontal slide plate 104 which is slideable in the horizontal ways 106. The slide plate 104 is adjustably positioned by a lead screw 108 which is in threaded engagement with a block 112 mounted on the slide plate 104 and its other end rotatably secured to a flange 114 on the ways 106. The cleaning head 20 may be adjustably positioned along the ways 106 by rotation of the lead screw 108 by a suitable crank or tool. The horizontal ways 106 are mounted on a vertical slide plate 116 which is slideable in vertical ways 118. The vertical ways 118 are fixedly mounted on the vertical plate 46 of the carriage. For vertical adjustment, a vertical lead screw 122 threadedly engages a block 124 on the slide plate 116 and is rotatably connected with a bracket 126 on the ways 118. The vertical slide plate 116 is adjustably positioned along the ways 118 by rotation of the lead screw 122 by a crank or other suitable tool.

The non-rotatable cleaning head 20 is universally adjustable relative to the tube bundle 14 to obtain optimum cleaning effect from the impact of the jet stream from the nozzles 94*a*, 94*b*, 94*c* and 94*d*. The cleaning head 20 may be adjusted in the vertical direction by rotation of the lead screw 122 to raise or lower the cleaning head relative to the tube bundle 14. Cleaning head 20 may be positioned horizontally by rotation of the lead screw 108 to move the cleaning head toward or away from the tube bundle 14. Thus, the cleaning head 20 may be moved to the desired position to obtain optimum effect for tube bundles of different diameters. Additionally, the manifold plates 84*a*, 84*b*, 84*c* and 84*d* may be adjustably positioned relative to each other by the adjustment screws 92*a*, 92*b*, 92*c* and 92*d* so that the respective sets of nozzles 94*a*, 94*b*, 94*c* and 94*d* are vertically off set from each other in accordance with the diameter of tubes in the tube bundle.

The rotary cleaning head 22 comprises a spinner 132, i.e. a rotary nozzle unit. The spinner 132 comprises a rotary hub 134 and a mounting flange 136. The mounting flange 136 is bolted to a vertical slide plate 138 for movement therewith. A cover plate 142 is connected with the slide plate 138 and has a circular opening 144 to accommodate the hub 134 of the spinner. The slide plate 138 is disposed behind the vertical plate 46 and the hub 134 extends through a rectangular slot 146 in the vertical plate 46. The slide plate 138 is slideable in a pair of ways 148 which are fixed to the face of the vertical plate 46. The spinner 132 is rotatably driven by a rotary hydraulic motor 152 which is mounted on the slide plate 138. The motor 152 is connected by a chain drive with a sprocket 154 on the shaft of the spinner 132. The spinner includes a pair of radial arms 156 and 158 extending from the hub 134. The arm 156 carries a pair of radially spaced nozzles 162 and the arm 158 carries a pair of radial spaced nozzles 164. The spinner has a inlet fitting 166 which is connected through the flexible hose to a fitting 168 and through hose 102 to the high pressure pump 24. The inlet fitting 166 communicates through the hub 134 and the arms 156 and 158 with the nozzles 162 and 164, respectively. The nozzles 162 and 164 are adapted to produce a solid stream of liquid at high velocity.

The slide plate 138 is vertically adjustable by a lead screw 172 which is rotatably supported in flange 174 and which coacts with a block (not shown) on the plate 138. By rotation of the lead screw 168, the rotary cleaning head 22 including the spinner 132 can be raised or lowered relative to the tube bundle 14 so that the path of the jet nozzles 162 and 164 covers a selected portion of the tube bundle.

Figure 8:
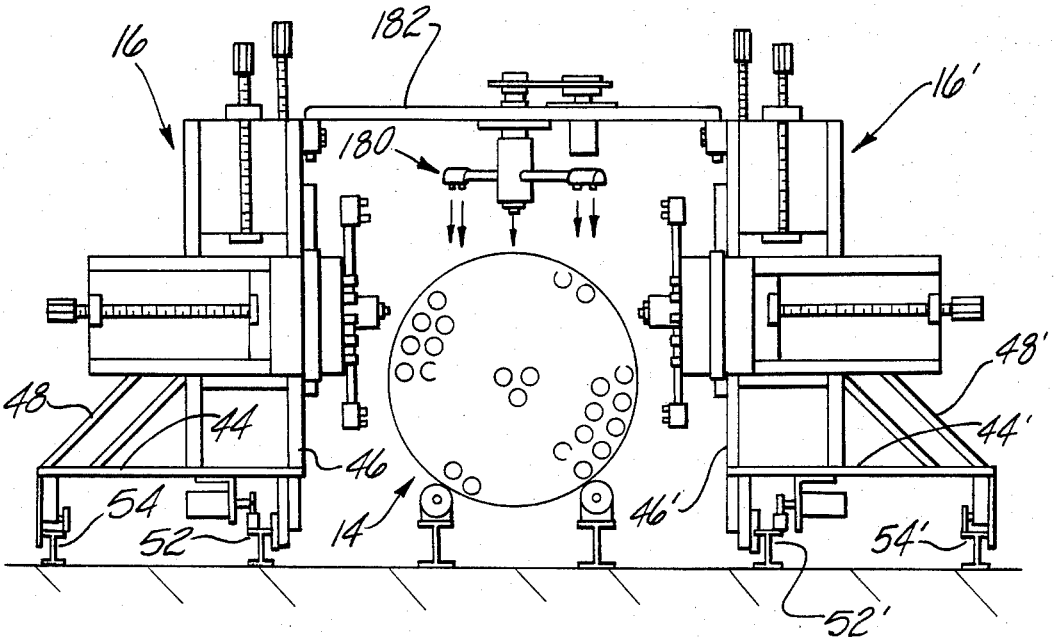
FIG. 8 shows an end elevation view of the apparatus with an additional rotary cleaning head.

FIG. 8 shows a modification of the cleaning apparatus. It is the same as that described above except that the third rotary cleaning head 180 is provided. For this purpose, a bridge plate 182 extends between the carriages 16 and 16' and is connected at opposite ends with the vertical plates 46 and 46'. The rotary cleaning head 180 is of the same construction as the cleaning heads 22 and 22'. It is disposed with its rotational axis in a vertical plane and centered on the tube bundle 14. The cleaning head 180 provides an additional stage of cleaning to each segment of the tube bundle.

It is noted that the cleaning apparatus 10 described above is adapted to be transportable from one site of operation to another. For this purpose, the set of tracks 18 and the set of tracks 18' comprise plural sections which are demountably connected at joints 192. Also, the set of rollers 12 are demountably connected by joints 194. Each of the plural sections of the tracks and of the rollers are of a suitable length, say 10 feet, for transportation by truck from one site to another. The carriages 16 and 16' are readily moved as separate units and thus may be transported by truck from site-to-site.

In use, the cleaning apparatus of this invention is set up at the work site and the tube bundle 14 to be cleaned is placed on the power rollers 12. The carriages 16 and 16' are moved to a starting position at one end of the tube bundle. The non-rotatable cleaning head 20 on the carriage 16 is adjusted vertically to the appropriate height for the diameter of the tube bundle by turning the lead screw 122. It is moved to the desired distance from the tube bundle by turning the lead screw 108. Also, the manifold nozzle plates 84*a*, 84*b*, 84*c* and 84*d* are adjusted in the vertical plane by turning the adjustment screws 92*a*, 92*b*, 92*c* and 92*d* so that the nozzles 94*a*, 94*b*, 94*c* and 94*d* are vertically offset a proper distance for the diameter of the tubes in the tube bundle. The rotary cleaning head 22 is raised or lowered to the desired height for the size of the tube bundle 14 by rotating the lead screw 172. The same adjustments are made on the non-rotatable cleaning head 20' and the rotatable cleaning head 22' on the carriages 16'. Preferably, the carriages 16 and 16' are located so that the non-rotatable cleaning heads 20 and 20' are diametrically opposite each other and the rotatable cleaning heads 22 and 22' are diametrically opposite each other relative to the tube bundle 14. With the cleaning heads properly adjusted, as described, and the carriages suitably aligned, the high pressure pump 24 is turned on and the nozzles of the cleaning head produce high velocity, solid liquid jets which impinge upon the desired area of the tube bundle. The rotary motor for the rotary heads 22 and 22' are energized to produce rotation at the desired rate, suitably ranging from 30 to 1,000 RPM. At the same time, the drive motors 66 are energized to cause the carriages 16 and 16' to traverse the respective tracks 18 and 18' from one end to the other and then to reverse direction and traverse back to the starting point. This traversing cycle is repeated until the desired cleaning effect has been achieved on the selected portion of the tube bundle. Then, the power rollers 12 are activated to re-orient the tube bundle so that another portion of the tube bundle is subjected to the cleaning action. This process is repeated until the entire tube bundle is properly cleaned.

Although the description of this invention has been given with reference to a particular embodiment, it is not to be construed in the limiting sense. Many variations and modifications will now occur to those skilled in the art. For a definition of the invention reference is made to the appended claims.

What is claimed is:

1. A tube bundle cleaning apparatus comprising:

a set of power-driven rollers adapted to receive a tube bundle for cleaning, a horizontal track extending parallel to said rollers, a carriage movably supported on said track, a non-rotatable cleaning head adjustably mounted on said carriage and including plural nozzles, each pointed transversely of said bundle and adapted to be connected with a source of high pressure fluid, first head positioning means for adjustably positioning said head on the carriage in the vertical direction, second head positioning means for adjustably positioning said head on the carriage in the horizontal direction toward and away from said tube bundle, nozzle positioning means for adjustably positioning each of said plural nozzles by translational movement relative to each other on said head, and means for moving the carriage along said track between the ends of said tube bundle.

2. The invention as defined in claim 1 including:

a rotary cleaning head mounted on said carriage and including a rotary member with a pair of diametrically opposite nozzles each pointed in a horizontal plane and adapted to be connected with a source of high pressure fluid.

3. The invention as defined in claim 1 wherein, said non-rotatable head comprises, a base member, a plurality of nozzle holders, each of the nozzle holders being slidably mounted on the base member whereby said plural nozzles can be positioned relative to each other.

4. The invention as defined in claim 3 including, a vertical slideway and a horizontal slideway, one of said slideways being mounted on said carriage and the other slideway being mounted on said one slideway, said base member being mounted on said one slideway whereby said base members can be positioned vertically and horizontally relative to said tube bundle.

5. The invention as defined in claim 3 wherein, each of said nozzle holders comprises a flat plate disposed in a vertical plane, successive ones of the flat plates being disposed face-to-face, each of said plates being slidably mounted for positioning in a vertical direction relative to each other whereby the respective nozzles may be adjustably positioned in the vertical direction.

6. The invention as defined in claim 5 wherein, plural nozzles are mounted on each of said flat plates and are spaced from each other in the vertical direction.

7. Tube bundle cleaning apparatus comprising:

a set of power-driven rollers adapted to receive a tube bundle for cleaning and to rotate said tube bundle about its longitudinal axis for positioning said bundle for cleaning, first and second horizontal tracks extending parallel to said rollers on opposite sides thereof, first and second carriages movably supported on said first and second tracks respectively, first and second non-rotatable cleaning heads adjustably mounted, respectively, on said first and second carriages, each of said cleaning heads including plural nozzles each of said nozzles being pointed transversely of said bundle in the horizontal plane and adapted to be connected with a source of high pressure fluid, first and second vertical positioning means for adjustably positioning said first and second heads on said first and second carriages, respectively, in the vertical direction, first and second horizontal positioning means for adjustably positioning said first and second heads on the first and second carriages, respectively, in the horizontal direction toward and away from said tube bundle, means for adjustably positioning each of said plural nozzles by translational movement on said respective heads relative to each other, and means for moving the carriage along said track between the ends of said tube bundle.

* * * * *